US011071369B2

(12) United States Patent
Caulier et al.

(10) Patent No.: US 11,071,369 B2
(45) Date of Patent: Jul. 27, 2021

(54) APPLICATOR FOR APPLYING A COSMETIC, MAKEUP OR CARE PRODUCT TO THE EYELASHES AND/OR EYEBROWS

(71) Applicant: L'OREAL, Paris (FR)

(72) Inventors: Eric Caulier, Ferrieres (FR); Alain Berhault, Clichy (FR); Audrey Thenin, Meudon (FR); Davide Manici, Mercenasco (IT)

(73) Assignee: L'OREAL, Paris (FR)

( * ) Notice: Subject to any disclaimer, the term of this patent is extended or adjusted under 35 U.S.C. 154(b) by 375 days.

(21) Appl. No.: 15/519,718

(22) PCT Filed: Oct. 15, 2015

(86) PCT No.: PCT/EP2015/073940
§ 371 (c)(1),
(2) Date: Apr. 17, 2017

(87) PCT Pub. No.: WO2016/059181
PCT Pub. Date: Apr. 21, 2016

(65) Prior Publication Data

US 2017/0238679 A1 Aug. 24, 2017

(30) Foreign Application Priority Data

Oct. 17, 2014 (FR) ..... 1459978

(51) Int. Cl.
*A45D 40/26* (2006.01)
*A46B 9/02* (2006.01)
*A46B 3/04* (2006.01)

(52) U.S. Cl.
CPC ..... *A45D 40/267* (2013.01); *A46B 3/04* (2013.01); *A46B 9/021* (2013.01); *A46B 9/026* (2013.01);
(Continued)

(58) Field of Classification Search
CPC .. A45D 34/042; A45D 34/043; A45D 34/045; A45D 40/262; A45D 40/267;
(Continued)

(56) References Cited

U.S. PATENT DOCUMENTS 6,412,496 B1 * 7/2002 Gueret ..... A45D 40/267 132/218
6,546,937 B2 * 4/2003 Gueret ..... A46B 9/021 132/218
(Continued)

FOREIGN PATENT DOCUMENTS

DE 202014103653 * 12/2015
EP 1 070 466 A2 1/2001
(Continued)

OTHER PUBLICATIONS

Dec. 16, 2015 International Search Report issued in International Patent Application No. PCT/EP2015/073940.

*Primary Examiner* — Yogesh P Patel
*Assistant Examiner* — Jennifer Gill
(74) *Attorney, Agent, or Firm* — Oliff PLC

(57) ABSTRACT

Applicator (2) for applying a cosmetic, makeup or care product (P) to the eyelashes and/or eyebrows, having a moulded applicator member (8) having: a core (10) that extends along a longitudinal axis (X), spikes (18) carried by the core (10), and reinforcing sails (1.3) for the spikes (18), which are connected by their base to the core (10). extend parallel to the longitudinal axis (X) of the core (10) and are disposed in a plurality of longitudinal rows (17, 19, 20), at least one first longitudinal row (17) being offset axially with respect to a second longitudinal row (19).

18 Claims, 2 Drawing Sheets

Figure 1:
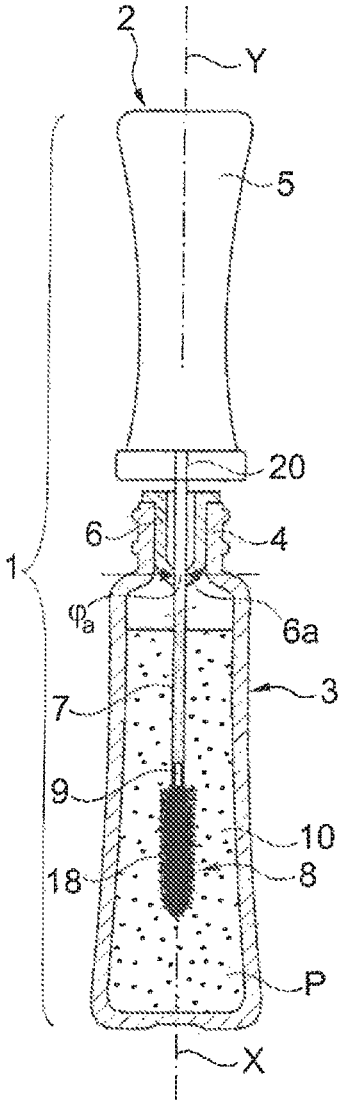

(52) U.S. Cl.
CPC ..... *A46B 9/028* (2013.01); *A46B 2200/1053* (2013.01)

(58) Field of Classification Search
CPC .... A46B 2200/1046; A46B 2200/1053; A46B 3/005; A46B 3/04; A46B 9/021; A46B 9/026; A46B 9/028; A46D 1/0238; A46D 1/0253
USPC ..... 132/218, 313, 320; D4/136; 15/186–188
See application file for complete search history.

(56) References Cited

U.S. PATENT DOCUMENTS

| | | | | |
|---|---|---|---|---|
| 2001/0037815 | A1 | 11/2001 | Gueret | |
| 2004/0255967 | A1† | 12/2004 | White et al. | |
| 2007/0062551 | A1 | 3/2007 | De Brouwer et al. | |
| 2011/0041863 | A1* | 2/2011 | Roualdes | A45D 19/02 132/114 |
| 2011/0229246 | A1* | 9/2011 | Kulik | A45D 40/262 401/129 |

FOREIGN PATENT DOCUMENTS

| | | | |
|---|---|---|---|
| EP | 1 767 119 | A1 | 3/2007 |
| WO | 01/05273 | A1 | 1/2001 |
| WO | 2006/090343 | A1 | 8/2006 |

* cited by examiner
† cited by third party

APPLICATOR FOR APPLYING A COSMETIC, MAKEUP OR CARE PRODUCT TO THE EYELASHES AND/OR EYEBROWS

The present invention relates to an applicator for applying a cosmetic, makeup or care product to the eyelashes and/or eyebrows, for example mascara.

The invention also relates to devices having a container which contains the product to be applied and is preferably provided with a wiping member, and the applicator.

The application EP 1 070 466 discloses applicators having application elements that are situated on one side of a core and are disposed on either side of a longitudinal rib resting on said core.

There is a need to further improve applicators for applying a product, in particular mascara, to the eyelashes and/or eyebrows, in order to improve the performance thereof, and more particularly to promote the creation on the applicator member of zones that are more heavily laden with product, which allow easy application of makeup and rapid and abundant loading of the eyelashes and/or eyebrows, while retaining a high capacity to separate the eyelashes and/or eyebrows.

The invention aims to meet this objective and the subject thereof, according to one of its aspects, is an applicator for applying a cosmetic, makeup or care product to the eyelashes and/or eyebrows, having a moulded applicator member having:

a core extending along a longitudinal axis, spikes carried by the core, and reinforcing sails for the spikes, which are connected by their base to the core, extend parallel to the longitudinal axis of the core and are disposed in a plurality of longitudinal rows, at least one first longitudinal row being offset axially with respect to a second longitudinal row.

By virtue of the reinforcing sails, the bases of the spikes are reinforced with respect to flexion in the longitudinal direction, and the spikes bend less during extraction of the applicator, this tending to prevent the wiping of the core. This makes it possible to obtain, on the applicator member, in particular at the base of the spikes, between the rows and between the spikes of the rows, zones that form reservoirs, which are wiped less as the applicator passes through the wiping member, thus providing a surplus of product along the entire length of the core and all around the latter after wiping. This surplus of product allows the eyelashes and/or eyebrows to be loaded with a large and satisfactory amount of product from the first application.

During application of makeup, these zones are emptied gradually of their contents, the eyelashes and/or eyebrows coming into contact with said zones. The eyelashes and/or eyebrows are thus properly loaded with product without the user having to reload the applicator too frequently by reintroducing it into the container.

The height and shape of the reinforcing sails can be varied during manufacturing in order to adjust the level to which the applicator is loaded with product after wiping.

The expression "longitudinal axis of the core" denotes the line connecting all of the centres of mass of the cross sections of the core. The longitudinal axis may be a central axis, or even an axis of symmetry for the core, in particular when the core has a circular cross section or a cross section in the overall shape of a regular polygon. The longitudinal axis of the core may be rectilinear or curved and may be contained in a plane, which may be a plane of symmetry for some, or even for all of the cross sections of the core. Preferably, the longitudinal axis of the core is rectilinear.

The term "spike" denotes an individualizable projecting element intended to come into engagement with the eyelashes and/or eyebrows.

The expression "axially offset longitudinal rows" should be understood as meaning that the reinforcing sails of the same rank in these rows do not occupy the same position along the longitudinal axis of the core.

Reinforcing Sails

Two opposite reinforcing sails advantageously flank each spike of the applicator member. Two opposite reinforcing sails may be symmetrical about the median plane of the spike that they flank.

In a preferred embodiment, the connection between a reinforcing sail and a spike is made along a ridge of the reinforcing sail, parallel to the elongation axis of the spike. The expression "elongation axis of the spike" denotes an axis which passes through the centres of mass of the cross sections of the spike.

Within one longitudinal row, the reinforcing sails of two consecutive spikes advantageously define a groove between one another. This makes it possible to create a reservoir of product between the spikes, providing a large load from the first application.

This groove may have a rounded bottom, and in particular be cylindrical about an axis perpendicular to the longitudinal axis of the core. The groove preferably extends entirely at a non-zero distance from the core.

The reinforcing sails advantageously have an approximately triangular shape, when the applicator member is viewed in a direction perpendicular to its longitudinal axis, and their side which extends obliquely may have a gradient of between 10° and 55° with respect to the longitudinal axis of the core.

The reinforcing sails of the spikes in two adjacent longitudinal rows may be not joined at their base. In one variant, the reinforcing sails of two adjacent longitudinal rows are joined together.

The height of the reinforcing sails is preferably less than the height of the spikes, and is in particular less than three quarters of the height of the spikes. The expression "height of a reinforcing sail" denotes the height of the ridge connecting the reinforcing sail to the spike to which it is connected, measured along the elongation axis of the spike. The expression "height of a spike" denotes the distance measured along the elongation axis of the spike between its free end and its base by way of which it is connected to the core.

The ratio between the height of the reinforcing sails and the height of the spikes may be between 0.05 and 0.2, better still between 0.06 and 0.15.

The height of the reinforcing sails may be constant along the longitudinal axis of the core, and is in particular between 0.1 mm and 0.5 mm, better still between 0.15 mm and 0.35 mm. In one variant, the height of the reinforcing sails varies along the longitudinal axis of the core, for example within one or more longitudinal rows and/or from one longitudinal row to another.

The thickness of the reinforcing sails may be less than the thickness of the spikes. The expression "thickness of a reinforcing sail" denotes the largest transverse dimension of the reinforcing sail, in section, perpendicularly to the longitudinal axis of the core. The expression "thickness of a spike" denotes the largest transverse dimension of the spike, in section, perpendicularly to the elongation axis of the spike and to the longitudinal axis of the core.

The thickness of the reinforcing sails may be between 0.2 mm and 0.75 mm, better still between 0.35 mm and 0.65 mm, and is in particular equal to around 0.4 mm.

The width of the reinforcing sails at their base is advantageously constant along the longitudinal axis of the core. The expression "width of a reinforcing sail" denotes the largest transverse dimension of the reinforcing sail, in section, along the longitudinal axis of the core. The width of the reinforcing sails at their base may be between 0.2 mm and 2 mm, better still between 0.5 mm and 0.9 mm, and is for example equal to 0.6 mm or 1 mm.

The reinforcing sails may narrow in the direction of the spikes, i.e. their thickness and their width may decrease in the direction of the free end of the spikes.

Core and Spikes

The spikes advantageously extend from the core and all around the latter. There are for example at least eight longitudinal rows of spikes.

The spikes and the reinforcing sails are advantageously disposed on the applicator member in a plurality of, preferably rectilinear, longitudinal rows.

Each longitudinal row is preferably offset axially with respect to the consecutive longitudinal row.

The spikes and the reinforcing sails in every other longitudinal row may all be at the same axial position along the longitudinal axis of the core.

The number of longitudinal rows may be even.

The spikes in two adjacent longitudinal rows may be not joined at their base.

Within one and the same longitudinal row, the spacing between two spikes of ranks n and n+1, measured along the longitudinal axis of the row, between the two respective median planes of the two spikes, may be between 0.5 mm and 2.5 mm, better still between 1 mm and 2 mm, and is in particular equal to around 1.8 mm.

The spikes can also be disposed in circumferential rows, referred to as crowns of spikes, that are each formed by spikes that occupy one and the same axial position on the longitudinal axis of the core.

The implantation of the spikes may be such that the angular offset a about the longitudinal axis of the core, between the spikes of two consecutive crowns of spikes, is non-zero, being preferably equal to half the angular pitch $\beta$ between two consecutive spikes in one and the same crown.

At least one spike may extend from the core along an elongation axis perpendicular to the surface of the core at the point at which the spike is attached to the core. Preferably, the spikes each extend from the core along an elongation axis perpendicular to the surface of the core at the point at which the spikes are attached to the core.

In a variant, the elongation axis of the spikes forms an angle other than 90° with the surface of the core at the point at which the spikes are attached to the core.

The height of at least one spike, measured from the core, may be between 0.5 mm and 3 mm, better still between 0.75 mm and 2 mm.

Preferably, the height of the spikes varies, for example in a monotonous manner, along the longitudinal axis of the core. In one variant, the height of the spikes is constant along the longitudinal axis of the core.

The spikes may have a flattened cross section, that is to say that they have, over at least a part of their height, a cross section, measured perpendicularly to their direction of elongation, which has an elongate shape in a flattening plane, that is to say is wider than it is thick.

Some spikes on the applicator, or even all of the spikes, may have a thickness of between 0.3 mm and 0.85 mm, better still between 0.45 mm and 0.75 mm, said thickness being in particular equal to around 0.5 mm.

Some spikes on the applicator, or even all of the spikes, may have a width of between 0.2 mm and 0.8 mm, better still between 0.35 mm and 0.65 mm, said width being in particular equal to around 0.4 mm. The expression "width of a spike" denotes the largest transverse dimension of the spike, in section, along the longitudinal axis of the core.

The spikes may have any shape, in particular a cylindrical or tapering shape, and preferably have a conical shape. In variants, the spikes have a semi-conical, frustoconical or pyramidal shape; in particular with a hexagonal base. In a further variant, the spikes have, in front view, a non-symmetrical shape and an outwardly convex edge, narrow over at least a part of their height away from the core and have a width that decreases towards said convex edge.

The cross section of the spikes may have a substantially circular, semi-circular (referred to as a half moon), elliptical or semi-elliptical shape, or may also be, for example, polygonal, in particular hexagonal.

At least one spike may be ended by a rounded, in particular hemispherical, free end, the radius of curvature of which may be between 0.08 mm and 0.2 mm, and is for example equal to around 0.15 mm.

The free ends of the spikes of the applicator member define an envelope surface of the applicator member, which is for example in the form of a cylinder of revolution along at least a part of its length.

The envelope surface may have a largest transverse dimension that is substantially constant along at least a part of the length of the applicator member, in particular along more than half the part of the core that carries the spikes.

The envelope surface may also have a cross section that varies along all or part of the length of the applicator member. The cross section of the envelope surface may for example have one or more extremes and for example at least one local minimum and two local maxima. The diameter of the envelope surface that passes through the tops of the spikes of smallest height may be between 5 mm and 7.5 mm, and is for example equal to around 6 mm. The diameter of the envelope surface of the applicator member that passes through the tops of the spikes of greatest height may be between 6.5 mm and 11 mm, and is for example equal to around 7.5 mm.

The core may have a cross section, taken perpendicularly to its longitudinal axis, with any, in particular a circular, shape. The largest cross section of the core, namely its diameter in the case in which the cross section of the core has a circular shape, may be between 1.8 mm and 3.2 mm, and is in particular equal to around 2.8 mm.

The core, the spikes and the reinforcing sails may be moulded from one and the same material, or in a variant they can be made from at least two different materials.

The core and/or the spikes and/or the reinforcing sails are preferably made of a thermoplastic material, in particular an elastomeric thermoplastic material.

Applicator

The applicator may have a stem that carries the applicator member at a first end and is fixed to a gripping member at a second end.

The core may be solid, being for example moulded with an end piece for fixing to the stem of the applicator.

The applicator member may be fixed to the stein by snap-fastening, adhesive bonding, welding, crimping, pressing, stapling, force-fitting, fitting in a cold state or fitting in a hot state, for example by an end piece of the applicator member being mounted in a housing in the stem. In a variant, the stem is received in a housing provided in the core.

It is also possible for the stein and the applicator member to be moulded or not to be moulded in one piece and from the same thermoplastic material.

The spikes and/or the reinforcing sails may be made of a material that is more or less rigid than a material used to produce the stem of the applicator to which the core is attached.

The core may extend along a longitudinal axis which, at at least one point along its length, forms a non-zero angle with the longitudinal axis of the stem to which the core is fixed. The applicator member may be angled at its attachment to the stem.

The stem may have a first, rigid portion that is extended on the distal side by a second, more flexible portion, for example made of elastomer, that carries the applicator member.

The visible length of the applicator member may be between 18 mm and 35 mm, better still between 22 mm and 29 mm, and is for example equal to around 24.5 mm.

The applicator may have between 150 and 456 spikes, for example between 168 and 300 spikes.

The first spike along the longitudinal axis of the core starting from the stem may be disposed at a non-zero distance from the proximal end of the core, in particular between 0.2 mm and 0.7 mm. The last spike along the longitudinal axis of the core starting from the stem may be disposed at a non-zero distance from the distal end of the core, in particular between 0.3 mm and 0.9 mm.

Application Device

A further subject of the invention is a device for packaging and applying a product to the eyelashes and/or eyebrows, having an applicator according to the invention, as defined above, and a container containing the product to be applied.

The gripping member of the applicator may form a cap for closing the container.

The container may have a wiping member suitable for wiping the stem and the applicator member, advantageously having a wiping lip defining an orifice.

The ratio between the diameter of the circumscribed circle that has as its centre the longitudinal axis of the core and passes through the tops of the reinforcing sails, in cross section perpendicular to the longitudinal axis of the core, and the diameter of the orifice defined by the lip of the wiping member may be between 0.55 and 1.15.

The product is preferably a mascara.

Figure 2A:
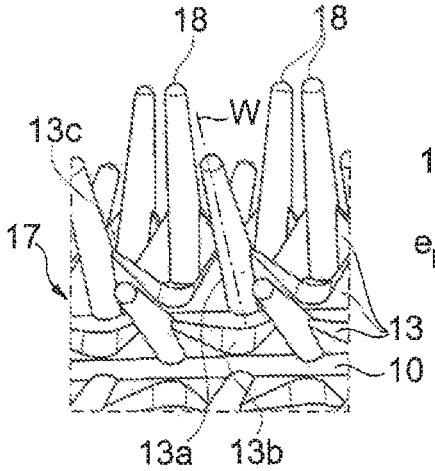
Figure 2B:
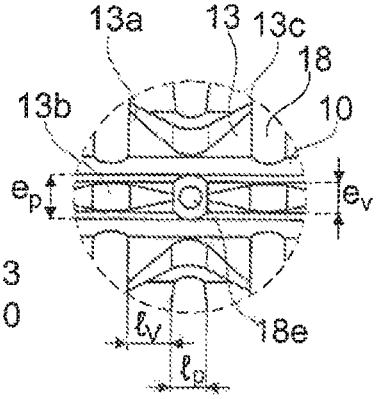
Figure 3:
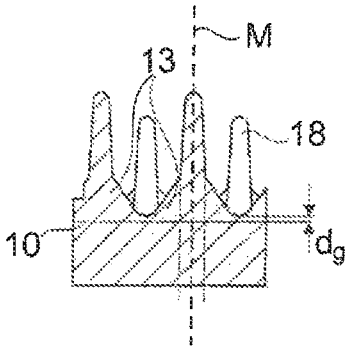
Figure 4:
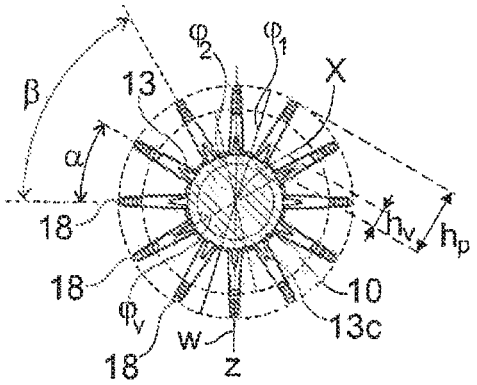
Figure 2:
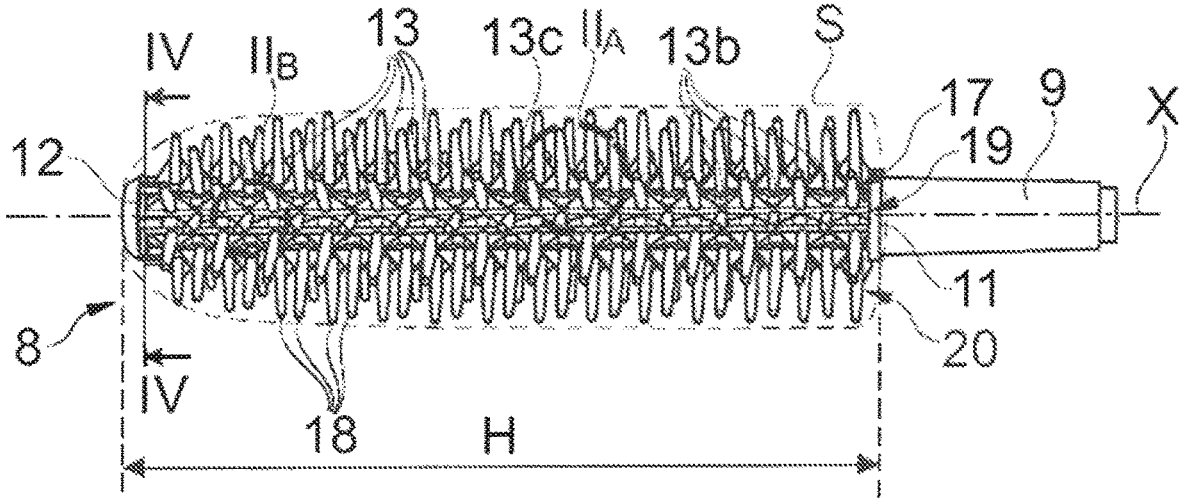

The invention may be better understood from reading the following detailed description of a non-limiting implementation example thereof, and with reference to the attached drawing, in which:

FIG. 1 is a schematic elevation view, in partial longitudinal section, of an exemplary packaging and application device produced in accordance with the invention, FIG. 2 shows a perspective view of the applicator member from FIG. 1 on its own, FIGS. 2A and 2B show details of the applicator member from FIG. 2, FIG. 3 is a view in longitudinal section of a detail of the applicator member from FIG. 2, and FIG. 4 is a section along IV-IV of the applicator member from FIG. 2.

FIG. 1 shows a packaging and application device 1 produced in accordance with the invention, having an applicator 2 and an associated container 3 containing a product P to be applied to the eyelashes and/or eyebrows, for example mascara or a care product.

The container 3 has, in the example in question, a threaded neck 4 and the applicator 2 has a closure cap 5 designed to be fixed on the neck 4 so as to close the container 3 in a sealed manner when it is not in use, the closure cap 5 also forming a gripping member for the applicator 2.

The latter has a stem 7 of longitudinal axis Y, which is attached at its upper end to the closure cap 5 and at its lower end to an applicator member 8. The latter has a core 10 that carries spikes 18 that extend from the core 10 and all around the latter. As can be seen in FIG. 2, the first spike 18 along the longitudinal axis X of the core 10 starting from the stem 7 is disposed at a non-zero distance $d_t$ from the proximal end 11 of the core, for example equal to around 0.35 mm. The last spike 18 along the longitudinal axis X of the core 10 starting from the stem 7 is disposed at a non-zero distance $d_d$ from the distal end 12 of the core 10, for example equal to around 0.55 mm.

The container 3 also has a wiping member 6, inserted into the neck 4.

This wiping member 6, which may be of any suitable type, has, in the example in question, a lip designed to wipe the stem 7 and the applicator member 8 when the applicator 2 is withdrawn from the container 3. The lip defines a wiping orifice 6*a* having a diameter adapted to that of the stem 7. The wiping member 6 may be made of elastomer. The wiping orifice 6*a* has for example a circular shape.

The diameter $\varphi_a$ of the wiping orifice 6*a* is typically between 3 and 5.5 mm, and is for example around 4.5 mm or 5 mm.

In the example illustrated, the stem 7 has a circular cross section, but if the stem 7 has some other section, this does not depart from the scope of the present invention, it then being possible to fix the cap 5 on the container 3 in some other way than by screwing, if necessary. The wiping member 6 is adapted to the shape of the stem. 7 and to that of the applicator member 8, if appropriate.

Preferably, and as in the example in question, the longitudinal axis Y of the stem 7 is rectilinear and coincident with the longitudinal axis of the container 3 when the applicator 2 is in place thereon, but if the stem 7 is not rectilinear, forming for example an elbow, this does not depart from the scope of the present invention.

If need be, the stem 7 may have an annular narrowing at its portion that is positioned opposite the lip of the wiping member 6, so as not to mechanically stress the latter unduly during storage.

As illustrated in FIG. 2, the applicator member 8 may have an end piece 9 for fixing it in a corresponding housing of the stem 7.

The applicator member 8 may be fixed in this housing of the stem 7 by any means, and in particular by force-fitting, snap-fastening, adhesive bonding, welding, stapling or crimping.

With reference to FIG. 2, it can be seen that the core 10 has a shape that is elongate along a longitudinal axis X, which is rectilinear in the example described. The longitudinal axis X may be central, as illustrated.

The visible length H of the applicator member 8 is for example equal to 24.5 mm.

In the example illustrated, the spikes 18 each extend from the core 10 along an elongation axis W perpendicular to the surface of the core at the point at which the spike 18 is attached to the core 10.

As can be seen in particular in FIG. 2, the applicator member 8 has reinforcing sails 13 for the spikes 18, which are attached by their base to the core 10 and extend parallel to the longitudinal axis X of the core 10.

Two opposite reinforcing sails 13 advantageously flank each spike 18 of the applicator member 8, said reinforcing sails 13 being, in the example described and as can be seen in particular in FIG. 3, symmetrical about the median plane M of the spike 18 that they flank.

In the example in question, the connection between a reinforcing sail 13 and a spike 18 is made along a ridge 13*a* of the reinforcing sail 13, parallel to the elongation axis W of the spike 18, as shown in FIG. 2A.

In the example described, the spikes 18 and the reinforcing sails 13 are disposed on the applicator member 8 in a plurality of rectilinear longitudinal rows 17, 19, 20, as can be seen in particular in FIG. 2, each longitudinal row 17 of spikes being offset axially with respect to the adjacent longitudinal row 19.

The spikes 18 and the reinforcing sails 13 in every other longitudinal row advantageously all occupy the same axial position along the longitudinal axis X of the core 10, as illustrated in FIG. 2, for example between the longitudinal rows 17 and 20.

In the example in question, the number of longitudinal rows is even, and is for example equal to 12.

The spikes 18 in two adjacent longitudinal rows 17, 19 may be not joined at their base, as can be seen in particular in FIG. 2A, this also being the case for the reinforcing sails 13 in two adjacent longitudinal rows.

As is shown, in particular in FIG. 2A, within one longitudinal row 17, the reinforcing sails 13 of two consecutive spikes 18 advantageously define between one another a groove 13*b*, which has a rounded bottom and is cylindrical about an axis perpendicular to the longitudinal axis X of the core 10 in the example in question. Said groove 13*b* preferably extends at a non-zero distance $d_g$, for example between 0.05 mm and 0.3 mm, from the core 10.

In the example described, the reinforcing sails 13 have an approximately triangular shape, in particular with a gradient of between 10° and 55° with respect to the longitudinal axis X of the core 10.

As can be seen in FIG. 4, for example, the height $h_v$ of the reinforcing sails 13 is preferably less than the height $h_p$ of the spikes 18, and is in particular less than three quarters of the height $h_p$ of the spikes 18.

The ratio $h_v/h_p$ between the height $h_v$ of the reinforcing sails 13 and the height $h_p$ of the spikes 18 may be between 0.05 and 0.2, better still between 0.06 and 0.15.

The height $h_v$ of the reinforcing sails 13 may be constant along the longitudinal axis X of the core 10, and be for example between 0.1 mm and 0.5 mm, better still between 0.15 mm and 0.35 mm.

The ratio between the diameter $\varphi_v$, of the circumscribed circle that has as its centre the longitudinal axis X of the core 10 and passes through the tops 13*c* of the reinforcing sails 13 and the diameter $\varphi_a$ of the orifice 6*a* defined by the lip of the wiping member 6 may be between 0.55 and 1.15.

The thickness $e_v$ of the reinforcing sails 13 is advantageously less than the thickness $e_p$ of the spikes 18, as shown in FIG. 2B. The thickness $e_v$ of the reinforcing sails 13 may be between 0.35 mm and 0.65 mm, and is for example equal to around 0.4 mm.

The width $l_v$ of the reinforcing sails 13 at their base is advantageously constant along the longitudinal axis X of the core 10. The width $l_v$ of the reinforcing sails 13 at their base may be between 0.5 mm and 0.9 mm, and is for example equal to 0.6 mm.

The reinforcing sails 13 may narrow in the direction of the spikes 18, their thickness and their width decreasing in the direction of the free end 18*e* of the spikes 18.

As can be seen in FIG. 2, the height $h_p$ of the spikes 18 may vary along the longitudinal axis X of the core 10. The height $h_p$ may decrease towards the distal end 12 of the core 10, so as to facilitate insertion into the container 3. This height $h_p$ may be between 0.5 mm and 3 mm, better still between 0.75 mm and 2 mm.

With reference to FIG. 4, the diameter $\varphi_2$ of the envelope surface formed by the spikes 18 of smallest height may be between 5 mm and 7.5 mm, and is for example equal to around 5.6 mm. The diameter $\varphi_1$ of the envelope surface of the applicator member 8 formed by the spikes 18 of greatest height may be between 6.5 mm and 11 mm, and is for example equal to around 7.5 mm.

The spikes 18 may narrow, in side view, in the direction of their free end 28, as can be seen in particular in FIG. 4.

The thickness $e_p$ of the spikes 18 may be between 0.3 mm and 0.7 mm, and is for example equal to around 0.5 mm, as in the example in question.

The width $l_p$ of a spike 18 may be between 0.35 mm and 0.65 mm, and is for example equal to around 0.4 mm.

As can be seen in particular in FIG. 4, the implantation of the spikes 18 may be such that the angle $\alpha$ about the longitudinal axis X of the core 10 between two consecutive crowns 21 and 22 of spikes 18, said crowns each being formed by spikes 18 that occupy one and the same axial position on the longitudinal axis X of the core 10, is non-zero, being for example equal to half the angular pitch $\beta$ between two consecutive spikes in a crown.

Within one and the same longitudinal row 17, the spacing $S_p$ between two consecutive spikes 18 may be between 1 mm and 2 mm, and is for example equal to 1.8 mm, as in the example described.

The spikes 18 may have various shapes. In the example in question, and as can be seen in particular in FIG. 4, the spikes 18 have a conical shape.

In the example in question, the free ends 28 of the spikes 18 define an envelope surface S of the applicator member 8, having a rectilinear longitudinal axis that is coincident with the longitudinal axis X of the core 10, and is rotationally symmetrical about said axis X.

The spikes 18 and the reinforcing sails 13 are made, in the example in question, in one piece with the core 10 by moulding thermoplastic material.

In order to mould the applicator member 8, use can be made of any thermoplastic material which is or is not relatively rigid, for example SEBS, a silicone, latex, a material having improved slip, butyl, EPDM, a nitrile, a thermoplastic elastomer, a polyester elastomer, a polyamide elastomer, a polyethylene elastomer or a vinyl elastomer, a polyolefin such as PE or PP, PVC, EVA, PS, SEBS, SIS, PET, POM, PU, SAM, PA or PMMA. It is also possible to use a ceramic, for example based on alumina, a resin, for example of the urea-formaldehyde type, and possibly a material containing graphite as filler. It is possible in particular to use the materials known under the trade names Teflon®, Hytrel®, Cariflex®, Alixine®, Santoprene®, Pebax® and Pollobas®, this list not being limiting.

In order to use the device 1, the user unscrews the closure cap 5 and withdraws the applicator member 8 from the container 3.

Once the applicator member 8 has passed through the wiping member 6, a particular quantity of product P remains between the spikes 18, in the grooves in the reinforcing sails 13, and between the rows, the spikes 18 not bending at their base on passing through the wiping member 6, creating reservoirs of product P along the entire length of the core 10 and on all sides, making it possible to load the eyelashes and/or eyebrows with product P in a satisfactory manner.

Of course, the invention is not limited to the exemplary embodiment which has just been described.

The applicator member 8 may be able to vibrate, that is to say that it is possible to apply vibrations thereto during application, combing or picking up of the product P, for example as described in the application WO 2006/090343.

In a further variant, the applicator member 8 may be able to rotate, that is to say that it may be made to carry out a rotational movement about the longitudinal axis X of the core 10, for example during application, combing or picking up of the product P.

In a further variant, the applicator member 8 may be able to be heated, that is to say have a heating element for heating the keratin fibres, the eyelashes and/or eyebrows, and/or the spikes 18 and/or the core 10 and/or the reinforcing sails 13 of the applicator member 8.

It is also possible for the applicator member 8 to be able to vibrate, to be able to rotate and to be heated, or only to be able to vibrate and to rotate, or only to be able to vibrate and to be heated, or only to be able to rotate and to be heated, or only to be able to vibrate or only to be able to rotate or only to be able to be heated.

The applicator member 8 may comprise any bactericidal agent such as silver salts, copper salts, preservatives and at least one preservative for the product P.

The core 10 and/or the spikes 18 and/or the reinforcing sails 13 may, furthermore, comprise particles, for example a filler, in particular a compound which is magnetic, bacteriostatic or absorbs moisture, or else a compound intended to produce roughness on the surface of the spikes 18 and/or of the reinforcing sails 13 or to help the eyelashes and/or eyebrows to slide on the spikes and/or the reinforcing sails. At least one of the core 10 and a spike 18 and a reinforcing sail 13 may be flocked, or undergo any heat or mechanical treatment.

The expression "having a" should be understood as being synonymous with "having at least one", and "between" is understood as including the limits, unless specified to the contrary.

The invention claimed is:

1. An applicator for applying a cosmetic, makeup or care product to the eyelashes and/or eyebrows, having a moulded applicator member having:

a core that extends along a longitudinal axis, and spikes carried by the core, wherein the spikes extend from the core and all around the core, wherein two opposite reinforcing webs flank each spike, a connection between each reinforcing web and each spike being made along a ridge parallel to an elongation axis of the spike, wherein said reinforcing webs are connected by their base to the core, extend parallel to the longitudinal axis of the core and are disposed in a plurality of longitudinal rows, each longitudinal row of spikes and its reinforcing webs and spikes extending continuously from a first proximal end of the core to a second distal end of the core, each longitudinal row being offset axially with respect to a consecutive longitudinal row, the spikes and the reinforcing webs in every other longitudinal row all being at a same axial position along the longitudinal axis of the core, wherein the reinforcing webs of two consecutive spikes of the spikes carried by the core define between one another a groove, wherein the reinforcing webs have an approximately triangular shape and wherein the reinforcing webs of two adjacent longitudinal rows of said plurality of longitudinal rows are not joined at their base.

2. The applicator according to claim 1, wherein the spikes of two adjacent rows of said plurality of longitudinal rows are not joined at their base.

3. The applicator according to claim 1, wherein the bottom of the groove extends at a non-zero distance from the core.

4. The applicator according to claim 1, wherein a height of the reinforcing webs is less than a height of the spikes.

5. The applicator according to claim 4, wherein the height of the reinforcing webs is less than three quarters of the height of the spikes.

6. The applicator according to claim 1, wherein a ratio between a height of the reinforcing webs and a height of the spikes is between 0.05 and 0.2.

7. The applicator according to claim 6, wherein the ratio between the height of the reinforcing webs and the height of the spikes is between 0.06 and 0.15.

8. The applicator according to claim 1, wherein a height of the reinforcing webs is constant along the longitudinal axis of the core.

9. The applicator according to claim 8, wherein the height of the reinforcing webs is between 0.1 mm and 0.5 mm.

10. The applicator according to claim 8, wherein the height of the reinforcing webs is between 0.15 mm and 0.35 mm.

11. The applicator according to claim 1, wherein a thickness of the reinforcing webs is less than a thickness of the spikes.

12. The applicator according to claim 1, wherein the reinforcing webs narrow in the direction of the spikes.

13. The applicator according to claim 1, wherein a width of the reinforcing webs at their base is constant along the longitudinal axis of the core.

14. The applicator according to claim 1, wherein the spikes are disposed along circumferential rows, two consecutive circumferential rows along the longitudinal axis of the core being offset angularly by a non-zero angle.

15. The applicator according to claim 14, wherein said non-zero angle is equal to half the angular pitch between the spikes of a circumferential row.

16. A device for packaging and applying a product to the eyelashes and/or eyebrows, having the applicator according to claim 1, having a stem that carries the applicator member at a first end and is fixed to a gripping member at a second end, and a container containing the product, said gripping member of the applicator forming a cap for closing the container.

17. The applicator according to claim 1, wherein said groove has a rounded bottom.

18. The applicator according to claim 17, wherein said rounded bottom of said groove is cylindrical about an axis perpendicular to the longitudinal axis of the core.

* * * * *